US007374194B2

(12) United States Patent
Naito et al.

(10) Patent No.: US 7,374,194 B2
(45) Date of Patent: May 20, 2008

(54) APPARATUS FOR BINDING BOOT TO BASE PLATE FOR SNOWBOARD

(75) Inventors: Hideyuki Naito, Tokyo (JP); Tosiaki Sato, Tokyo (JP); Yoshinori Uchie, Tokyo (JP)

(73) Assignee: Carmate Mfg. Co., Ltd., Tokyo (JP)

( * ) Notice: Subject to any disclaimer, the term of this patent is extended or adjusted under 35 U.S.C. 154(b) by 325 days.

(21) Appl. No.: 10/751,735

(22) Filed: Jan. 6, 2004

(65) Prior Publication Data

US 2004/0135348 A1 Jul. 15, 2004

Related U.S. Application Data

(63) Continuation-in-part of application No. 10/167,615, filed on Jun. 13, 2002, now Pat. No. 6,974,149.

(30) Foreign Application Priority Data

Jun. 14, 2001 (JP) ..... P. 2001-179623

(51) Int. Cl.
*A63C 9/00* (2006.01)
*A63C 11/00* (2006.01)

(52) U.S. Cl. ..... 280/611; 280/809

(58) Field of Classification Search ..... 280/809, 280/611, 620, 623, 627, 633, 634, 11.3, 11.31; 36/7.2, 117.2

See application file for complete search history.

(56) References Cited

U.S. PATENT DOCUMENTS 360,561 A 4/1887 Clow
1,527,915 A 2/1924 Phelan
3,852,943 A 12/1974 Healy
4,856,810 A 8/1989 Smith
4,938,644 A 7/1990 Runels
5,142,798 A * 9/1992 Kaufman et al. ..... 36/117.4
5,143,396 A 9/1992 Shaanan et al.
5,172,924 A * 12/1992 Barci ..... 280/14.22
5,758,895 A 6/1998 Bumgarnerd
5,901,975 A 5/1999 Phipps
5,967,542 A 10/1999 Williams et al.
5,971,407 A 10/1999 Zemke et al.
6,061,870 A 5/2000 Dodge et al.
6,076,848 A 6/2000 Rigal et al.

(Continued)

FOREIGN PATENT DOCUMENTS

EP 793983 A1 10/1997

(Continued)

*Primary Examiner*—Christopher P. Ellis
*Assistant Examiner*—Bridget Avery
(74) *Attorney, Agent, or Firm*—Posz Law Group, PLC; R. Eugene Varndell, Jr.

(57) ABSTRACT

An apparatus for binding a boot to a base plate of a snowboard, having: a first band mounted on a first side of the base plate; a second band mounted on a second side of the base plate opposite the first side of the base plate in a width direction, the second band being removably attached to the first band, so as to fasten a toe end portion of the boot to the base plate wherein the second band fastens the toe end portion at an acute angle with respect to the base plate and the toe end portion of the boot.

9 Claims, 13 Drawing Sheets

U.S. PATENT DOCUMENTS

| | | | |
|---|---|---|---|
| 6,173,475 | B1 | 1/2001 | Senn et al. |
| 6,206,403 | B1 | 3/2001 | Black et al. |
| D455,187 | S | 4/2002 | Janisch |
| 6,390,492 | B1 | 5/2002 | Bumgarner et al. |
| 6,446,362 | B1 | 9/2002 | Martin et al. |
| 6,554,295 | B2 | 4/2003 | Rittmeyer |
| 6,581,944 | B1 | 6/2003 | Marmonier et al. |
| 6,679,516 | B2 | 1/2004 | Andrevon |
| 6,974,149 | B2 | 12/2005 | Naito et al. |
| 2006/0033310 | A1 | 2/2006 | Naito et al. |

FOREIGN PATENT DOCUMENTS

| | | | |
|---|---|---|---|
| FR | 2 774 302 | * | 8/1999 |
| JP | 9187543 | | 7/1997 |
| JP | 2000-093571 A | | 4/2000 |
| JP | 3076919 | | 8/2001 |
| JP | 3081397 | | 8/2001 |
| JP | 3081398 | | 8/2001 |
| WO | WO99-35412 | | 7/1999 |

* cited by examiner

Fig. 33 A
Fig. 33B
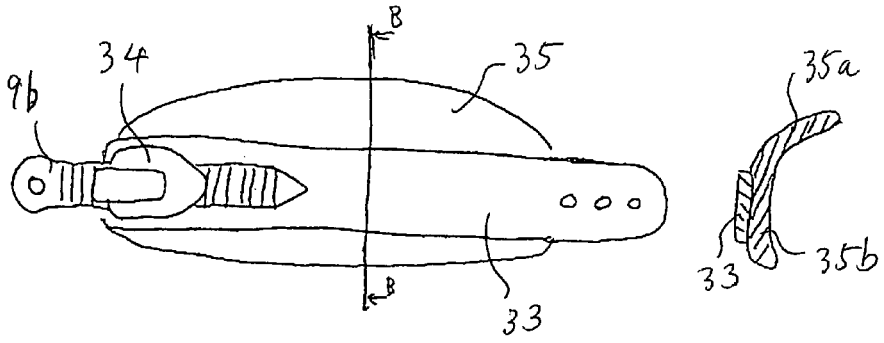
Fig. 34A
Fig. 34B
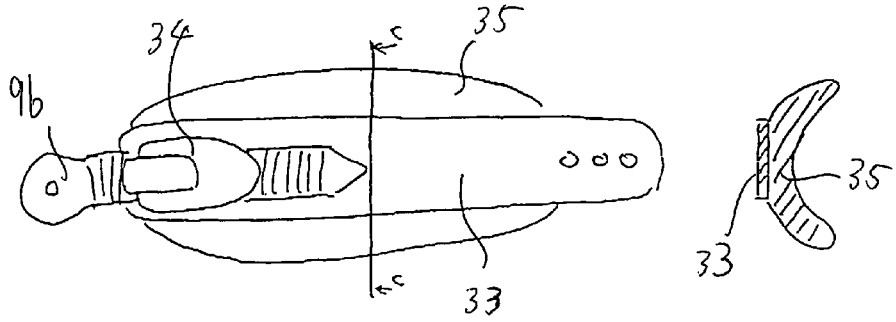

APPARATUS FOR BINDING BOOT TO BASE PLATE FOR SNOWBOARD

CROSS-REFERENCE TO RELATED APPLICATION

This application is a continuation-in-part application of U.S. Ser. No. 10/167,615, filed Jun. 13, 2002 now U.S. Pat. No. 6,974,149.

BACKGROUND OF THE INVENTION

1. Field of the Invention

The present invention relates to a binding for a snowboard.

2. Description of the Related Art

Now, FIG. 30 is an explanatory view of a conventional binding for a snowboard. In FIG. 30, reference numeral 1 designates a base plate to be fixed to a snowboard main body (not shown); 2: a boot; 3: a back support fixed to the rear end of the base plate 1 in such a manner that it can be contacted with the rear surface of the boot 2; 4: a cushion mounted on the inner surface of the back support 3; 5: an ankle strap disposed on the base plate 1 for fastening the instep of the boot 2; 6: ankle strap pad mounted on the inner surface of the ankle strap 5; 7: a toe strap disposed on the base plate 1 for fastening the tiptoe portion of the boot 2; and 8: a toe strap pad mounted on the inner surface of the toe strap 7, respectively.

Now, FIG. 31 is an explanatory detailed view of the toe strap.7. In FIG. 31, reference numeral 9*a* designates one band having one end thereof fixed to the one-side rising portion 10 of the base plate 1; 9*b*: the other band having one end thereof fixed to the other-side rising portion 10 of the base plate 1; 11: a buckle connected to the free end of the other band 9*b*; 12: a ratchet belt connected to the buckle 11; and 13: a lock part including a ratchet pawl for connecting the ratchet belt 12 to one band 9*a*.

By the way, the ankle strap 5 has the same structure as the toe strap 7.

In the thus structured binding for as now board, when mounting the boot 2 onto the base plate 1, the engagements between the ratchet belts 12 and lock parts 13 of the ankle strap 5 and toe strap 7 are removed, and one band 9*a* and the other band 9*b* are separated from each other by both hands. After then, the boot 2 is placed onto the base plate 1 from above thereof, the ratchet belt 12 is inserted into the lock part 13 including a ratchet pawl in such a manner as shown in FIGS. 31 and 32, and the buckle 11 is then fastened to thereby fix the instep portion and tiptoe portion of the boot 2 to the base plate 1.

In the binding of this type, in the rising portion 10 of the base plate 1, there are formed a plurality of holes which are used to fix one of the bands 9*a*, 9*b* such that the position thereof can be adjusted. That is, when adjusting the boot fixed state again, without removing the base plate from the snowboard, one of the bands is removed from its previously engaged one of the plurality of holes and is inserted into a new one of the plurality of holes to fix the boot to the base plate.

However, since the bands 9*a*, 9*b* and the rising portions 10 of the base plate 1 are fixed by bolts and nuts, a tool must be used to mount and remove them, which is troublesome.

Also, because the toe strap 7 is simply fastened from the upper portion of the tiptoe portion thereof, there is play in the tiptoe direction, so that the boot cannot be fastened sufficiently.

SUMMARY OF THE INVENTION

The present invention aims at eliminating the drawbacks found in the above binding for a snowboard.

In attaining the object, according to the first aspect of the present invention, there is provided an apparatus for binding a boot to a base plate of a snowboard, having: a first band mounted on a first side of the base plate; a second band mounted on a second side of the base plate opposite the first side of the base plate in a width direction, the second band: being removably attached to the first band, so as to fasten a toe end portion of the boot to the base plate,wherein the second band fastens the toe end portion at an acute angle with respect to the base plate and the toe end portion of the boot.

It is preferable that the apparatus further having: a pad attached to one of the first band and the second band at an upper surface of the pad, and the toe end portion of the boot at a lower surface of the pad.

It is preferable that the pad is a soft material, for example, urethane foam, EVA (chloroethene) and sewed product made from natural leather, artificial leather or cloth.

It is preferable that the pad comprises a first plate contacting a front surface of the toe end portion of the boot, and a second plate contacting an upper surface of the toe end portion of the boot, the first plate being adjacent to the second plate.

It is preferable that the pad is a hard material, for example plastic molded component, metal pressed component and FRP (Fiberglass reinforced Plastic) component.

In attaining the object, according to a second aspect of the present invention, an apparatus for binding a boot to a base plate of a snowboard, having: a first band mounted on a first side of the base plate; a second band mounted on a second side of the base plate opposite the first side of the base plate in a width direction; and a pad mounted on the first band at a first portion and removably attached to the second band at a second portion, wherein the pad fastens a toe end portion of the boot at an acute angle with respect to the base plate and the toe end portion.

In attaining the object, according to a third aspect of the present invention, an apparatus for binding a boot to a base plate of a snowboard, having: a fixing structure connects a first side of the base plate to a second side of the base plate at an acute angle with respect to a toe end of the boot; and a first band that removably connects the fixing structure connects to the first side of the base plate.

It is preferable that the fixing structure having: a first belt for fastening an upper portion of the toe end of the boot to the base plate; a second belt for fastening a front portion of the toe end of the boot to the base plate, the first belt and the second belt being connected to each other at first ends thereof and connected to each other at second ends thereof; and a second band connected removably to the first ends of the first belt and the second belt, and connected fixedly to the second side of the base plate, wherein the second ends of the first belt and the second belt are removably connected to the first band.

It is preferable that the first belt and the second belt are formed integrally with respect to each other.

It is preferable that the fixing structure having: a first belt for fastening an upper portion of the toe end of the boot to the base plate; and a second belt for fastenings front portion of the toe end to the of the boot to the base plate, the first belt and the second belt being fixedly connected to each other at first ends thereof and removably connected to each other at second ends thereof, wherein the first ends of the first belt and the second belt are removably connected to the first band, and the second ends of the first belt and the second belt are removably connected directly to the second side of the base plate.

It is preferable that the first ends of the first belt and the second belt are adjustable with respect to the first band, and the second ends of the first belt and the second belt are not adjustable with respect to the second of the base plate.

It is preferable that the first ends of the first belt and the second belt are adjustably connected directly to the second side of the base plate.

It is preferable that the apparatus for binding a boot to a base plate of a snowboard further having: a pad for covering the toe end of the boot disposed between the first belt and the second belt.

It is preferable that the first belt, the second belt and the pad are formed integrally with respect to each other.

It is preferable that the first band is adjustable with respect to the first ends of the first belt and the second belt.

BRIEF DESCRIPTION OF THE DRAWINGS

FIG. 33A is a plan view of another modification of the band shown in FIG. 25;

FIG. 33B is a section view taken along the line B-B shown in FIG. 33A;

FIG. 34A is a plan view of another modification of the band shown in FIG. 25;

FIG. 34B is a section view taken along the line C-C shown in FIG. 34A;

DESCRIPTION OF THE PREFERRED EMBODIMENTS

Now, description will be given below of the preferred embodiments of a binding for a snowboard according to the invention with reference to the accompanying drawings.

Figure 1:
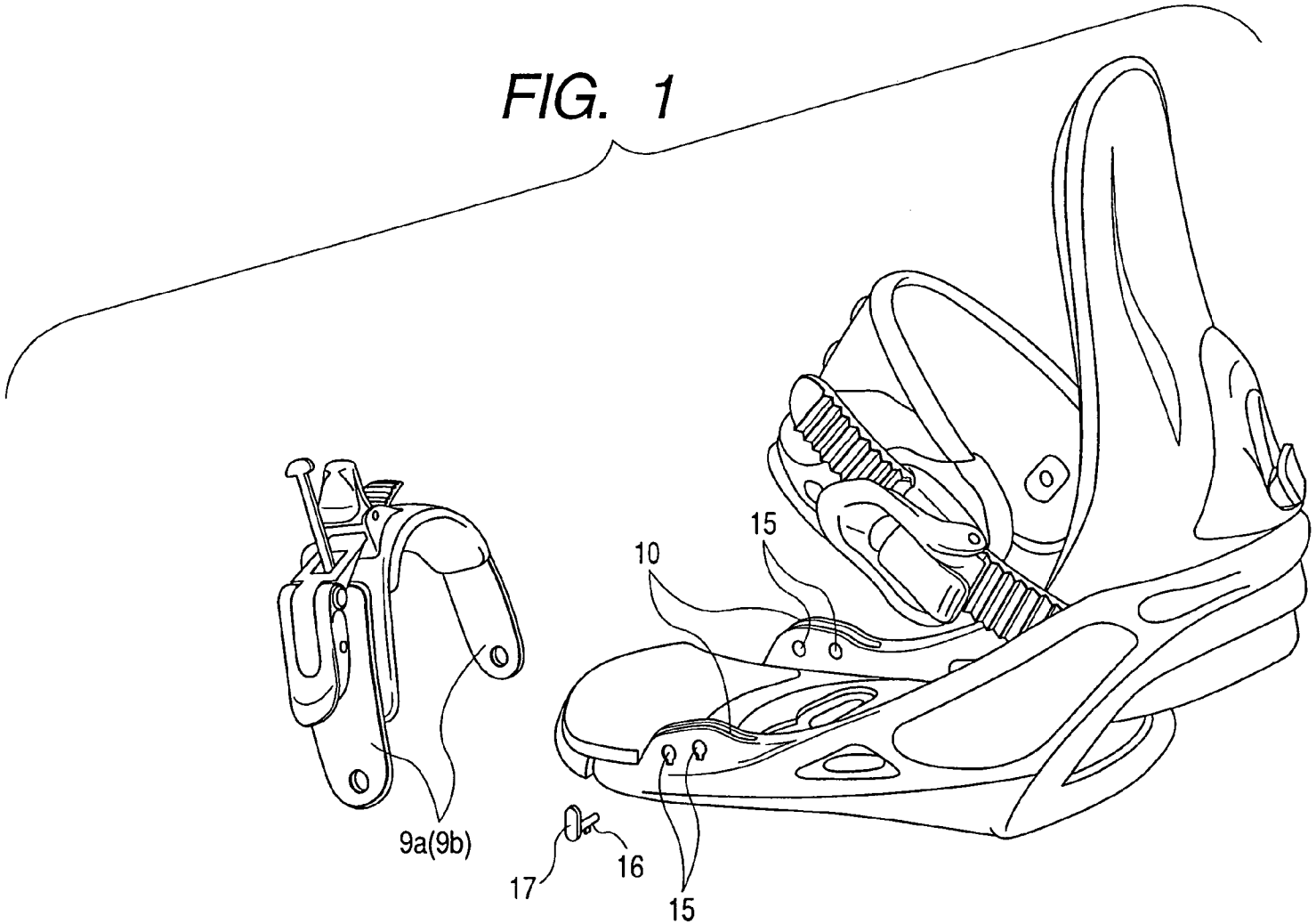
FIG. 1 is a perspective view of the binding for a snowboard of the invention.
Figure 2:
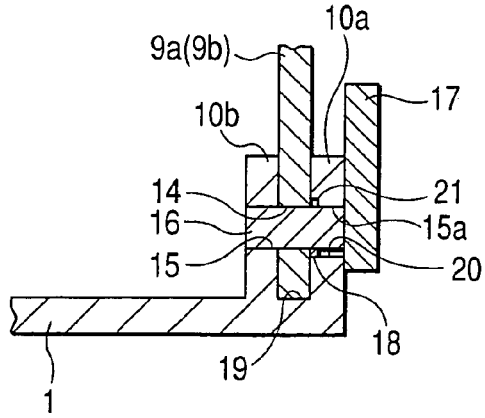
FIG. 2 is a longitudinal front view of a first embodiment of fixing means for fixing together bands and the rising portion of a base plate used a binding for a snowboard according to the invention.

In a binding for a snowboard according to the invention, as fixing means for fixing one of bands 9*a*, 9*b* of an ankle strap 5 and a toe strap 7 to the rising portion 10 of a base plate 1, instead of bolts and nuts, as shown in FIGS. 1 to 7, there is used a pin 16. FIG. 1 shows a perspective view of the binding for a snowboard of the invention. The pin 16 is inserted into a hole(first hole) 14 formed in one of the bands 9*a*, 9*b* as well as one of a plurality of holes(second holes) 15 formed in the rising portion 10 of the base plate 1. In addition, a lever 17 for rotating the pin 16 is fixed to the outer end of the pin 16 in such a manner that it is perpendicular to the pin 15.

In the rising portion 10 of the base plate 1 in which the hole 15 is formed, there is formed an insertion groove 19 which is used to insert the above band into the central portion of the upper end face of the rising portion 10; and, due to formation of the insertion groove 19, the rising portion 10 forks into outer and inner sections 10*a* and 10*b*. A hole to be formed in the outer section 10*a* of the forked rising portion 10 is formed as a hook-shaped hole (like key hole) 15*a* including a hook groove 20 formed in an inner surface thereof. On one side surface of the outer end portion of the pin 16, there is provided a projection 18 which corresponds to the hook groove 20. And, in an arbitrary depth portion of the hole 15*a*, there is concentrically formed an arc-shaped groove 21 which communicates with the hook groove 20 and corresponds to the projection 18 in length and width.

By the way, the groove 19 may be omitted. That is, the inner section of the forked shape of the rising portion 10 of the base plate 1 may not be formed.

Figure 3:
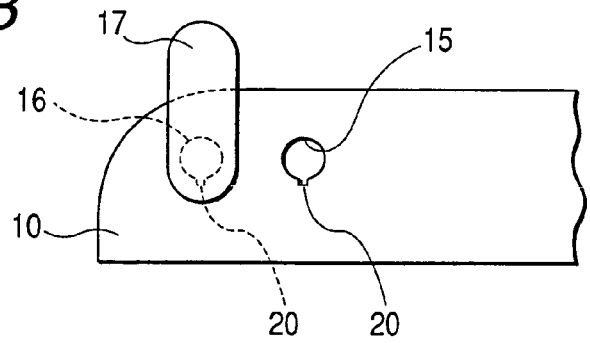
FIG. 3 is a side view of the bands and the rising portion of a base plate used in a binding for a snowboard according to the invention shown in FIG. 2.
Figure 4:
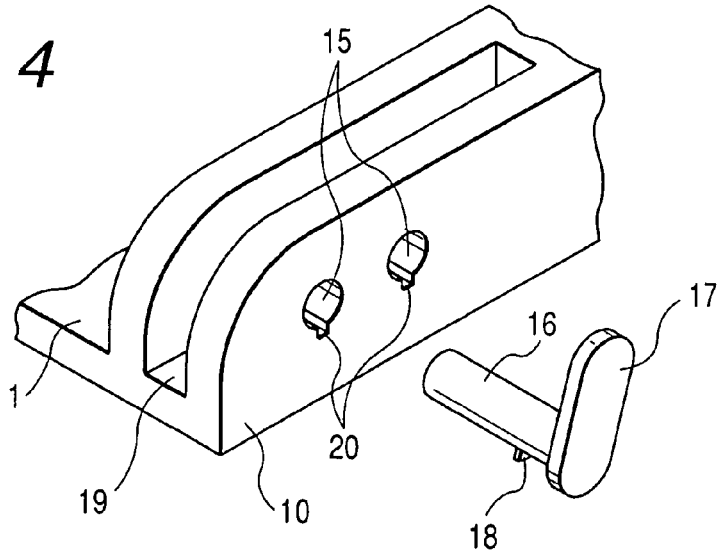
FIG. 4 is an explanatory view of the rising portion of the base plate of a binding for a snowboard according to the invention.
Figure 5:
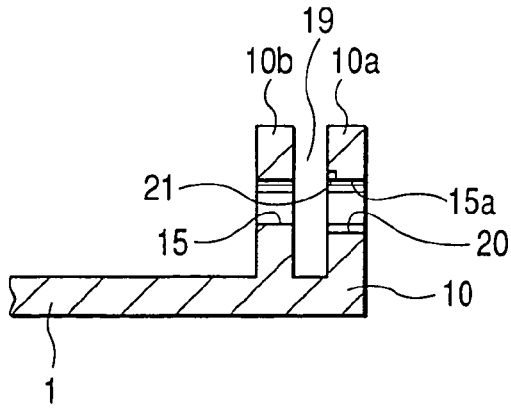
FIG. 5 is a longitudinal front view of the rising portion of the base plate of a binding for a snowboard according to the invention.
Figure 6:
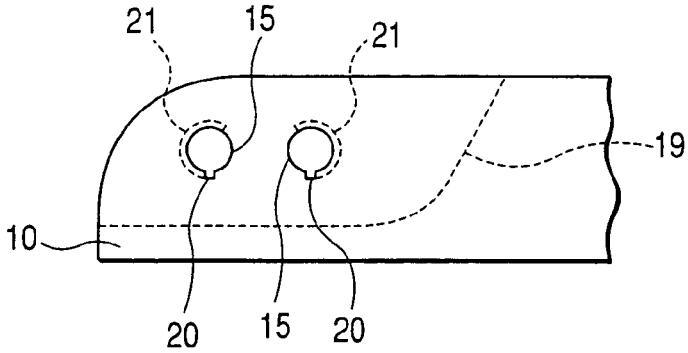
FIG. 6 is a side view of the rising portion of the base plate of a binding for a snowboard according to the invention.
Figure 7:
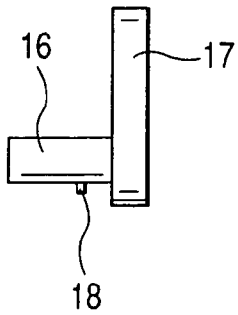
FIG. 7 is a front view of a pin and a lever used in a binding for a snowboard according to the invention.
Figure 8:
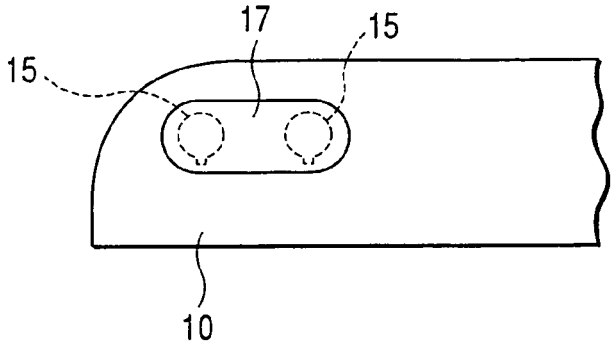
FIG. 8 is an explanatory side view of a modification of the first embodiment of the fixing means for fixing together the bands and the rising portion of the base plate used in a binding for a snowboard according to the invention.

Since a binding for a snowboard according to the invention is structured in the above-mentioned manner, as shown in FIG. 3, in case where the pin 16 of the lever 17 is inserted into the hole 15 of the rising portion 10 and the hole 14 of the band in a state where the projection 18 of the pin 16 is situated at a position corresponding to the hook groove 20 of the hook-shaped hole 15*a*. For example, in a state where the lever 17 stands erect, the projection 18 of the pin 16 is guided through the hook groove 20 up to the arc-shaped groove 21. In this state, as shown in FIG. 8, in case where the lever 17 is inclininglyrotated clockwise, for example, by 90°, the projection 18 is allowed to move within-the arc-shaped groove 21 to a position where the projection 18 is unable to return from the hook groove 20. Therefore, the pin 16 is prevented from removing from the hole 15, so that one of the bands 9*a*, 9*b* can be positively fixed to the base plate 1.

By the way, in case where the lever 17 is made to slidingly contact with the outer surface of the outer section 10*a* of the rising portion 10, and in a state where the projection 18 of the pin 16 is inserted into the arc-shaped groove 21, the lever 17 can be prevented from playing.

Figure 9:
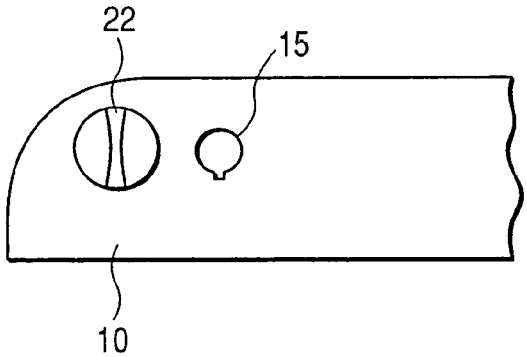
FIG. 9 is an explanatory side view of a second embodiment of the fixing means for fixing together the bands and the rising portion of a base plate in a binding for a snowboard according to the invention.
Figure 10:
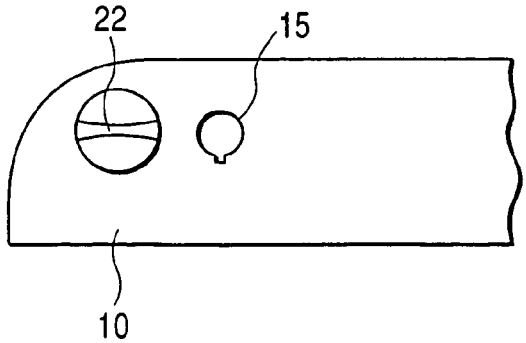
FIG. 10 is an explanatory side view of the fixing means shown in FIG. 9 in a binding for a snowboard according to the invention.

Also, as shown in FIGS. 9 and 10, instead of the lever 17, there may be used a circular-shaped knob part 22. That is, using the knob part 22, the pin 16 may be rotated.

Figure 11:
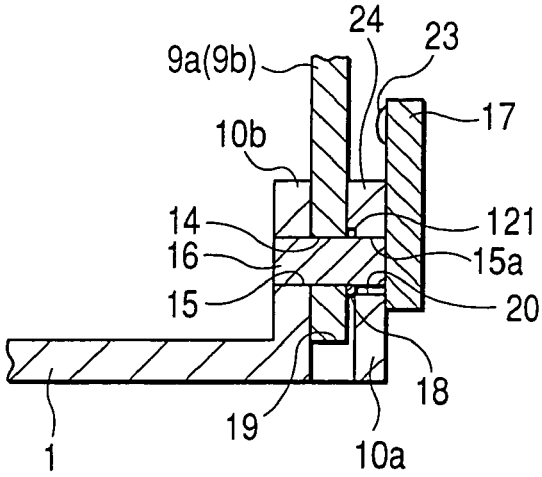
FIG. 11 is an explanatory side view of a third embodiment of fixing means used in a binding for a snowboard according to the invention.
Figure 12:
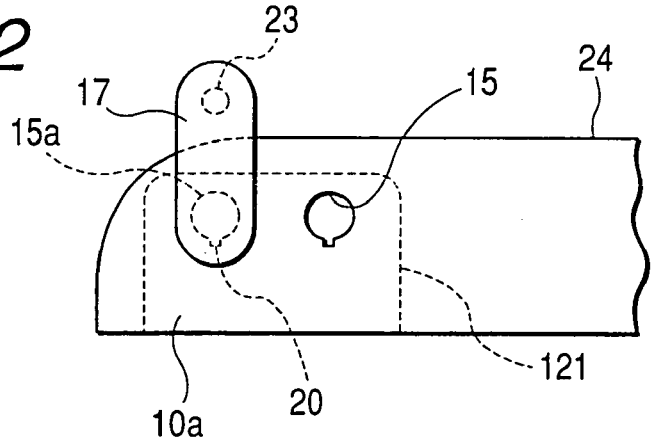
FIG. 12 is an explanatory side view of the fixing means shown in FIG. 11 in a binding for a snowboard according to the invention.
Figure 13:
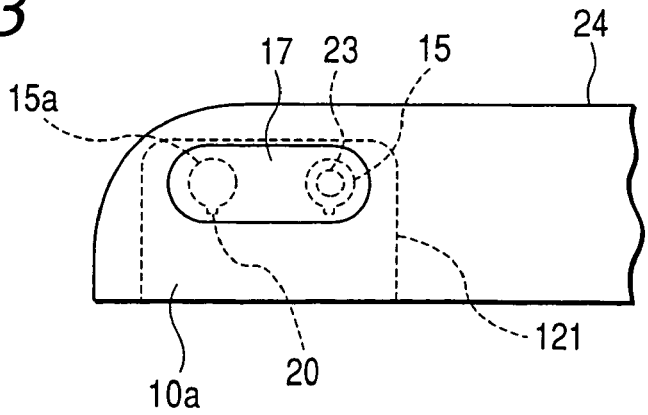
FIG. 13 is an explanatory side view of the fixing means shown in FIG. 11 in a binding for a snowboard according to the invention.

Now, FIG. 11 shows a third embodiment of fixing means used in a binding for a snowboard according to the invention. In the present embodiment, on the side of the loose end portion of the lever 17 that is opposed to the outer surface of the outer section 10*a* of the rising portion 10, there is provided a projected portion 23. In addition to this, the band 9*a*(9*b*) and the rising portion 10*a* define a space 121 for accommodating a projected portion 18 of the pin 16. The rising portion 10*a* has a thin-wall part surrounding a hole 15*a* with the hook groove 20, and the space 121 defined between the band 9*a*(9*b*) and the thin-wall part accommodates the projected portion 18 of the pin 16, the space 121 being communicated with the hook grove. As shown in FIG. 12, in the position relation where the pin 16 and the projection 18 are inserted into the hole 15*a* and groove 20, the projected portion 23 is situated at a position beyond the end face 24 of the outer section 10*a* of the rising portion 10. And, in case where the lever 17 is inclininglyturned clockwise from this position, as shown in FIG. 13, the projected portion 23 is moved up onto the end face 24 of the outer section 10*a* of the rising portion 10. After then, the lever 17 is flexed and is thereby slidingly contacted with the outer surface of the outer section 10*a*. For example, when the lever 17 is inclininglyrotated by a given angle such as by 90°, the projected portion 23 may be fitted into the other hole 15 of the rising portion of the base plate 1. According to the present embodiment, there is eliminated a fear that the lever 17 can be rotated without good reason and the pin 16 can be removed from the hole 15 without good reason.

Figure 14:
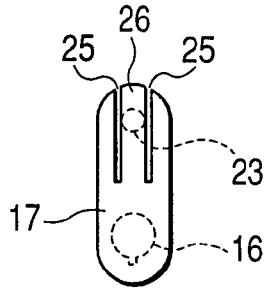
FIG. 14 is an explanatory side view of a modification of the third embodiment of fixing means used in a binding for a snowboard according to the invention.

By the way, as shown in FIG. 14, in the direction from the free end face of the lever 17 to the base portion thereof, there may be formed two slits 25 with the projected portion 23 between them to thereby facilitate the flexing of a lever portion 26 having the projected portion 23.

Figure 15:
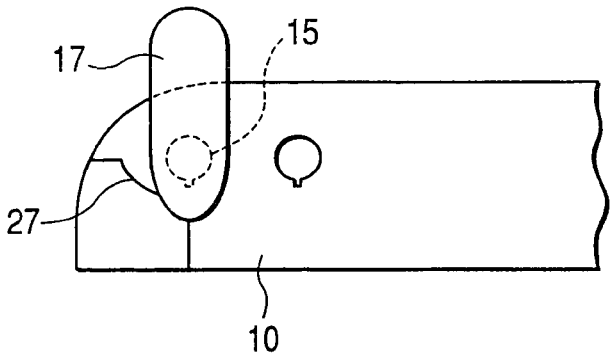
FIG. 15 is side view of a fourth embodiment of fixing means for fixing together bands and the rising portion of a base plate in a binding for a snowboard according to the invention.
Figure 16:
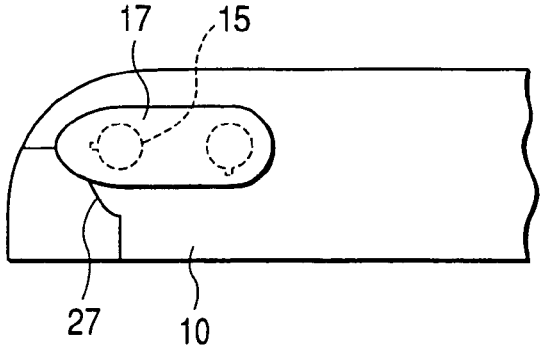
FIG. 16 is an explanatory side view of the fixing means shown in FIG. 15 in a binding for a snowboard according to the invention.
Figure 17:
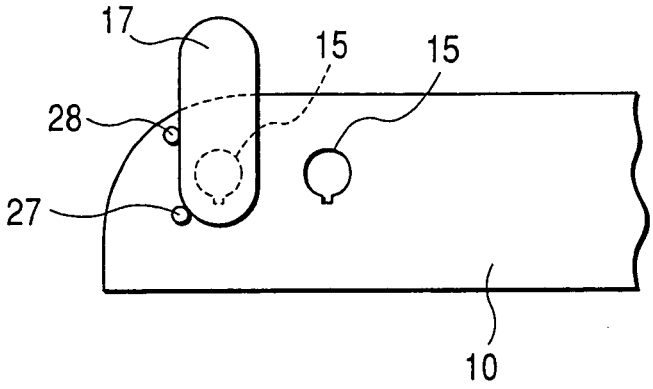
FIG. 17 is side view of a fifth embodiment of fixing means for fixing together the bands and the rising portion of a base plate in a binding for a snowboard according to the invention.
Figure 18:
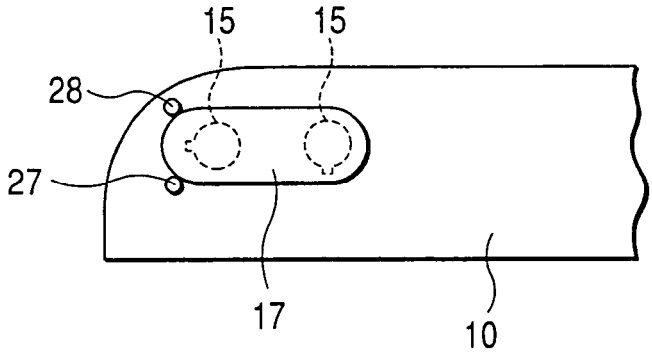
FIG. 18 is an explanatory side view of the fixing means shown in FIG. 17 in a binding for a snowboard according to the invention.
Figure 19:
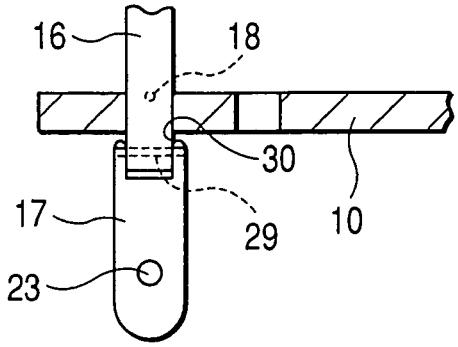
FIG. 19 is a transverse plan view of a sixth embodiment of fixing means used in a binding for a snowboard according to the invention.

Now, FIGS. 15 and 16 show a fourth embodiment of fixing means used in a binding for a snowboard according to the invention. In the present, instead of the projected portion 23 provided in the third embodiment, there is provided a projected surface. 27 in the outer surface of the outer section 10*a* of the rising portion 10. When the lever 17 is inclininglyturned clockwise from its erect state shown in FIG. 15 by 90° into its another state shown in FIG. 16, the lower surface of the base end of the lever 17 may be situated at a position beyond the projected surface 27. According to the present embodiment, there is no possibility that the lever 17 can play counterclockwise, thereby being able to prevent the pin 16 from being removed from the hole 15 without good reason. By the way, the projected surface 27, as shown in FIGS. 17 and 18, may also be replaced with a pin 27. In this case, in order to prevent the lever 17 from rotating excessively clockwise from the state shown in FIG. 18, preferably, there may be provided a stop pin 28.

Figure 20:
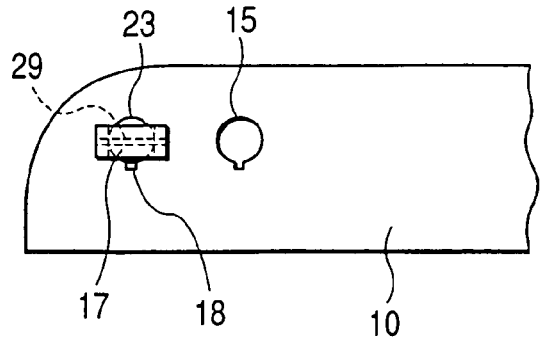
FIG. 20 is a side view of a lever shown in FIG. 19 in a binding for a snowboard according to the invention.
Figure 21:
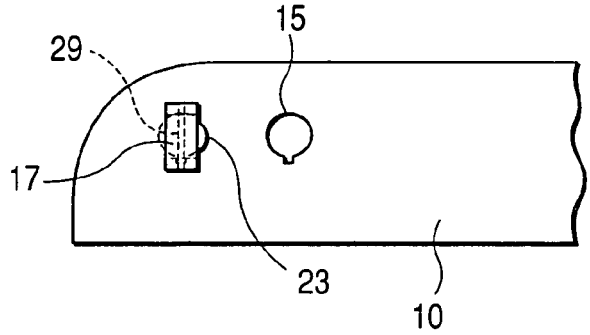
FIG. 21 is an explanatory side view of the lever shown in FIG. 19 in a binding for a snowboard according to the invention.
Figure 22:
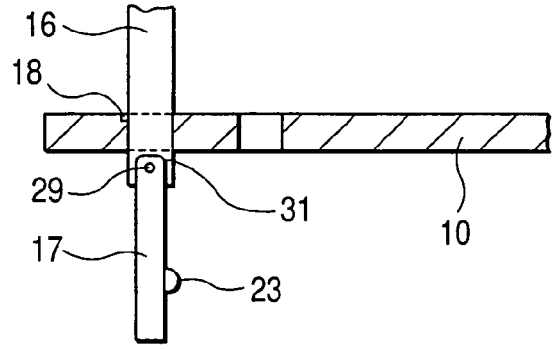
FIG. 22 is an explanatory transverse plan view of the lever shown in FIG. 19 in a binding for a snowboard according to the invention.
Figure 23:
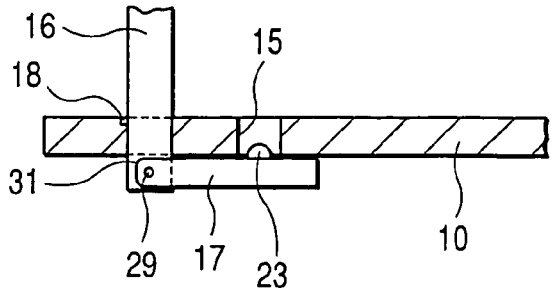
FIG. 23 is an explanatory transverse plan view of the lever shown in FIG. 19 in a binding for a snowboard according to the invention.

Now, FIGS. 19 to 23 show a fourth embodiment of fixing means used in a binding for a snowboard according to the invention. In the present embodiment, there is formed a groove 30 in the base end portion of the lever 17 to thereby turn the lever 17 into a forked shape. The outer end portion of the pin 16 is inserted into the groove 30, and the lever 17 and pin 16 are pivotally supported through a pivot support pin 29 in such a manner that they can be inclininglyrotated with respect to each other. And, in a state where, as shown in FIG. 20, the longitudinal-direction axis of the lever 17 is matched to the axis of the pin 16, the pin 16 is inserted into the hole 15 of the rising portion 10 and also into the hole 14 of the belts 9*a*, 9*b*. Then, as shown in FIGS. 21 and 22, the lever 17 is rotated clockwise by 90° about the axis of the pin 16. Next, as shown in FIG. 23, the lever 17 is inclininglyrotated about the pivot support pin 29 by 90° with respect to the pin 16 to thereby fit the projected portion 23 into the other hole 15 in such a manner that the corner portion 31 of the forked end face of the lever 17 can be elastically engaged with the outer surface of the outer section 10*a* of the rising portion 10. According to the present embodiment, there is eliminated a fear that the lever 17 can be played with respect to the pin 16 without good reason and the pin 16 can be removed from the hole 15 without good reason.

In the embodiments shown in FIGS. 1 to 23, there are provided a pin having a projection and a plurality of holes having hook grooves and a arc-shaped grooves. However, a pin having a hook groove and a arc-shaped groove formed coaxially with the associated pin, and a plurality of holes each having a projection maybe adopted into these embodiments of the present invention.

Figure 24:
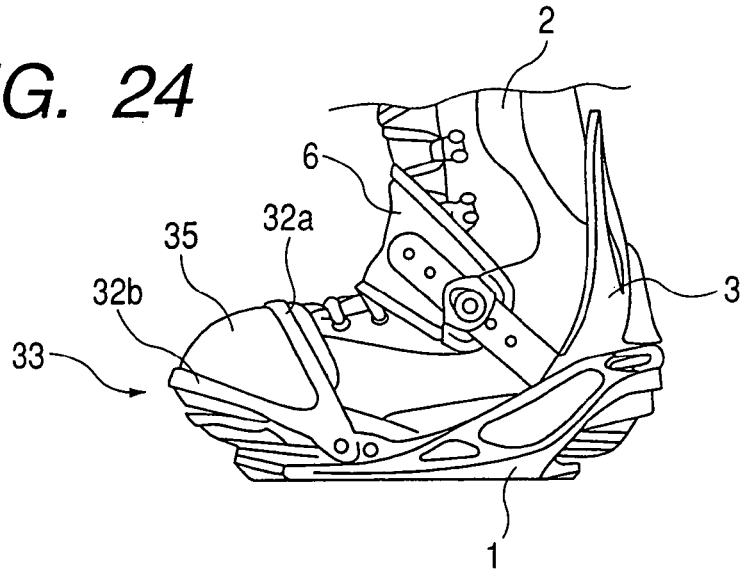
FIG. 24 is an explanatory side view of another embodiment of a binding for a snowboard according to the invention.
Figure 25:
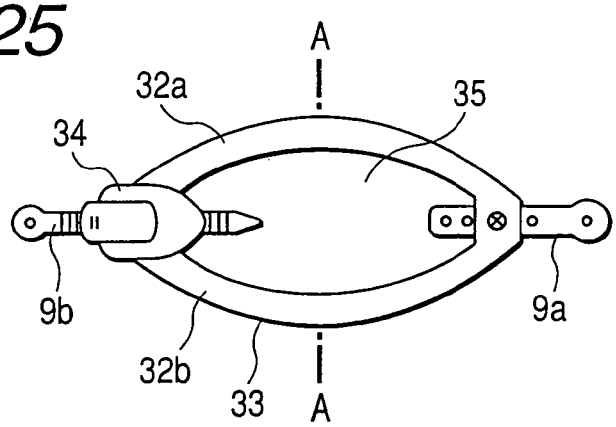
FIG. 25 is a plan view of the main portions of the binding for a snowboard according to the invention shown in FIG. 24.

Now, FIGS. 24 and 25 show a sixth embodiment of fixing means used in a binding for a snowboard according to the invention. In the present, one end of a band 33 is fixed to the free end of one (for example, 9*a*) of the bands 9*a*, 9*b* of the conventional toe strap 7. One end of a band 33 is composed of one belt 32*a* for fastening the upper portion of the tiptoe portion of a boot and the other belt 32*b* for fastening the leading end portion of the tiptoe portion of the boot. On the other end of the band 33, a buckle 34 is mounted. One end of the band 9*b* is inserted into the buckle 34 to thereby fasten the band 33 and, at the same time, an expandable pad or a connecting member 35 is fixedly interposed between the belts 32*a* and 32*b*. The belts 32*a* and 32*b* may preferably be formed of the material that can be expanded and compressed to a slight degree.

In the present embodiment, the upper portion and leading end portion of the tiptoe portion of the boot can be fastened at the same time using one belt 32*a* and the other belt 32*b*.

Figure 26:
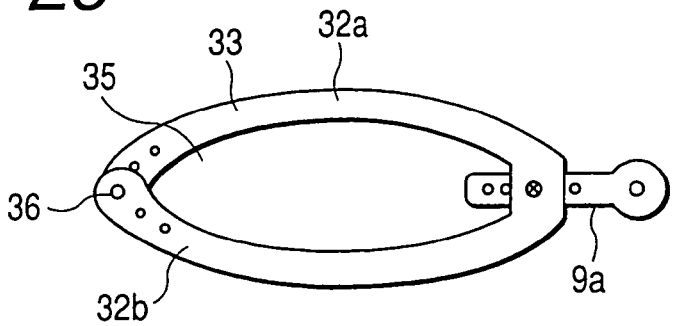
FIG. 26 is a plan view of a modification of the band shown in FIG. 25.
Figure 27:
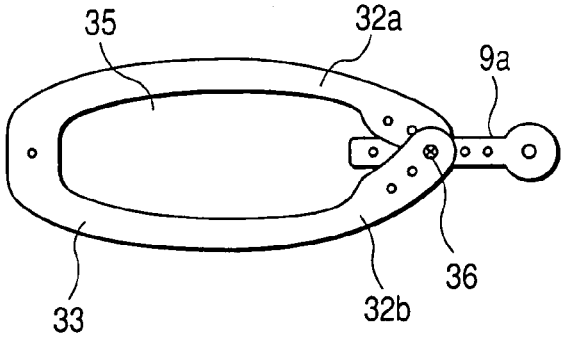
FIG. 27 is a plan view of another modification of the band shown in FIG. 25.

By the way, the two end portions of one belt 32*a* and the other belt 32*b* may be formed integrally with each other, or, as shown in FIGS. 26 and 27, one-side end portions of the belts 32*a* and 32*b* may be formed integrally with each other, while the other-side end portions thereof may be pivotally supported by a pin 36 in such a manner that they can be incliningly rotated with respect to each other.

Figure 28:
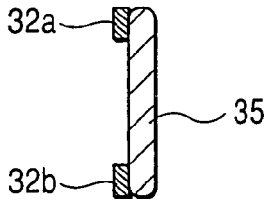
FIG. 28 is a section view taken along the line A-A shown in FIG. .25.
Figure 29:
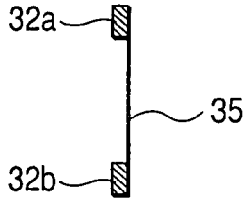
FIG. 29 is an explanatory view of a modification of a pad shown in FIG. 28.
Figure 30:
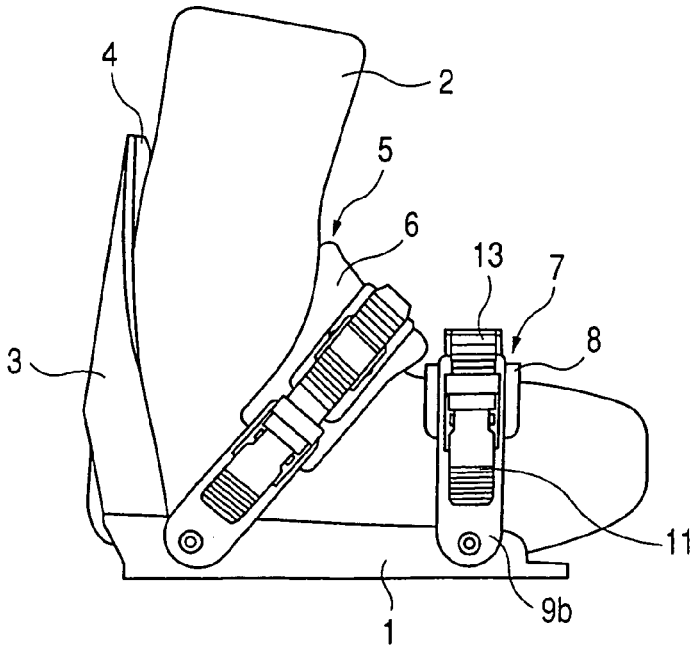
FIG. 30 is a side view of a conventional binding for a snowboard.
Figure 31:
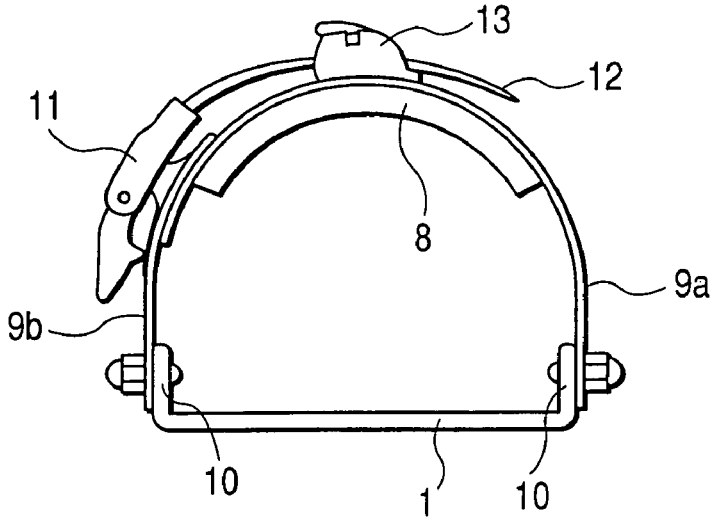
FIG. 31 is a front view of a conventional binding for a snowboard.
Figure 32:
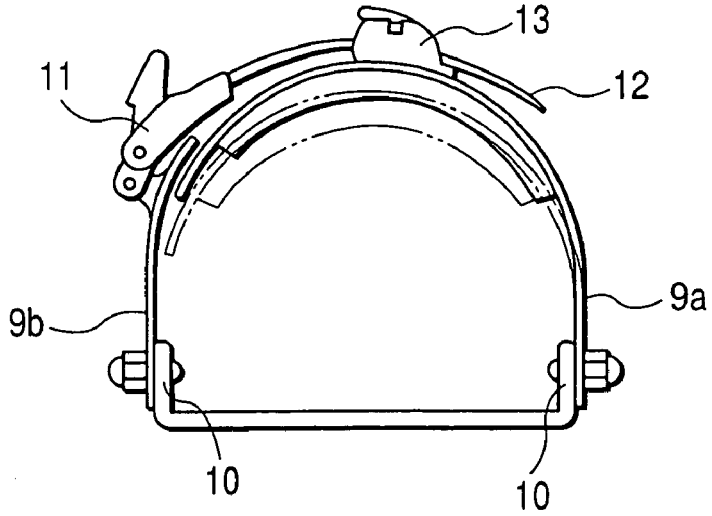
FIG. 32 is an explanatory front view of the conventional binding for a snowboard shown in FIG. 31.

Also, the connecting member 35, as shown in FIG. 28, may be formed of the material that is thick and has good cushioning, or, as shown in FIG. 29, it may be formed of the material that has good cushioning and is thin.

While only certain embodiments of the invention have been specifically described herein, it will apparent that numerous modifications may be made thereto without departing from the spirit and scope of the invention.

As has been described heretofore, in a binding for snowboard according to the invention, there can be provided a great advantage that the bands of the ankle strap and toe strap can be removed easily from the base plate without using a tool.

Also, there can be obtained another great advantage that the upper portion and leading end portion of the tiptoe portion of the boot can be fastened at the same time and thus the boot can be fixed positively to the binding for a snowboard without producing any play in the tiptoe direction of the boot.

FIGS. 33A to 34B show further embodiments of the present invention. In these embodiments, pad 35 (connecting member) can fasten both of the upper portion and leading end portion of the tiptoe portion of the boot at the same time with using belt 33 fixed on the pad 35.

FIG. 33B shows B-B sectional view of FIG. 34A. A pad 35 shown in FIGS. 34A and-34B has a first part 35*b* contacting on a front end portion of a tiptoe portion of a boot and a second portion 35*a* contacting on an upper portion of the tiptoe portion of the boot. Preferably, the pad 35 is made of hard material so as to correspond to a shape of the tiptoe portion, for example, plastic molded component, metal pressed component and FRP (Fiberglass reinforced Plastic) component.

FIG. 34B shows C-C sectional view of FIG. 34A. A pad 35 shown in FIGS. 34A and 34B is made of soft material so as to fit the shape of the tiptoe portion of the boot. The soft material is, for example, urethane foam, EVA (chloroethene) and sewed product made from natural leather, artificial leather or cloth.

FIGS. 35A to 36B show further embodiments of the present invention. In these embodiments, pad 35 can fast both of the upper portion and leading end portion of the tiptoe portion of the boot at the same time by coupling two belts 9*a* and 9*b* through pad 35 or directly each other.

Figure 35A:
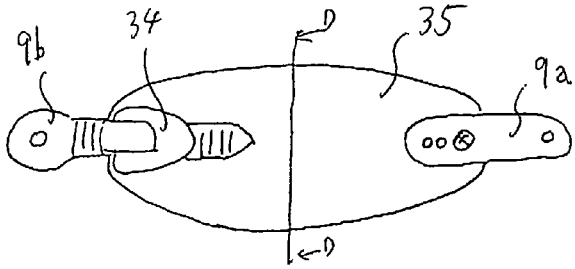
FIG. 35A is a plan view of another modification of the band shown in FIG. 25.
Figure 35B:
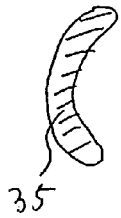
FIG. 35B is a section view taken along the line D-D shown in FIG. 35A.

FIG. 35B shows D-D sectional view of FIG. 35A. As shown in FIG. 35A, one belt 9*a* is attached on one end portion of a pad 35, and a buckle 34 is attached on the other end portion of the pad 35. The pad 35 of this embodiment can be made by the above mentioned soft material. However, in the case of using the soft material, it is preferable that cloth or the like may be adhibited on the pad 35 in order to secure breaking strength of the pad.

Figure 36A:
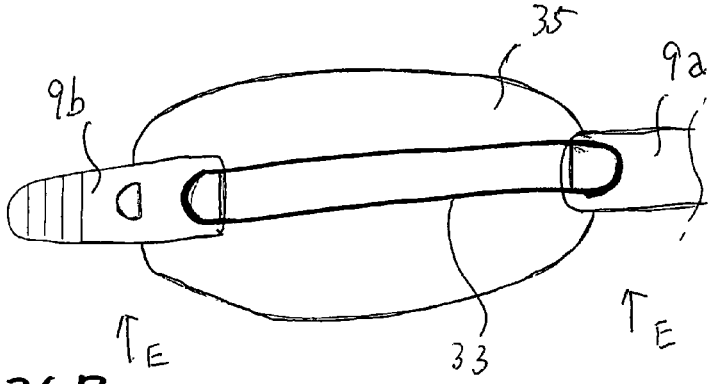
FIG. 36A is a plan view of another modification of the band shown in FIG. 25.
Figure 36B:
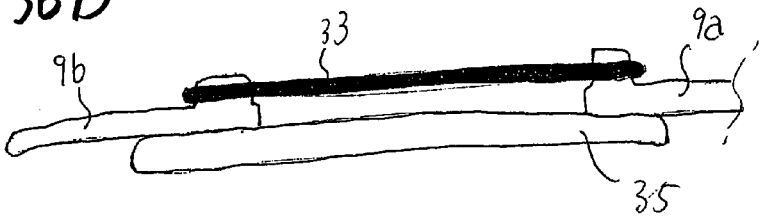
FIG. 36B is a view taken along the E arrow shown in FIG. 36A.

FIG. 36B shows E arrow view of FIG. 36A. As shown in FIG. 36A, one belt 9*a* is attached on one end portion of a pad 35 the one belt 9*a* and the other belt 9*b* have protrusions respectively. In a state that the other belt 9*b* is disposed on the pad 35, as shown in FIG. 36 B, circular wire 33 is hooked both of the protrusions of the belts 9*a* and 9*b*. Therefore, the pad 35 is fastened by the belts 9*a* and 9*b*.

What is claimed is:

1. An apparatus for binding a boot to a base plate of a snowboard, comprising:

a first band mounted on a first side of the base plate;

a second band mounted on a second side of the base plate opposite the first side of the base plate in a width direction, the second band being removably attached to the first band, so as to fasten a toe end portion of the boot to the base plate, the second band fastening the toe end portion at an acute angle with respect to the base plate and the toe end portion of the boot;

a pad comprising lower part with an inner surface contacting a forwardmost surface of the toe end portion of the boot, an upper part with an inner surface contacting an upper surface of the toe end portion of the boot and a convex intermediate part connecting the upper and lower parts, the lower part of the pad being attached to an inner surface of one of the first band and the second band.

2. The apparatus for binding a boot to a base plate of a snowboard as set forth in claim 1, wherein the pad includes a soft material.

3. The apparatus for binding a boot to a base plate of a snowboard as set forth in claim 1 wherein the pad includes a hard material.

4. An apparatus for binding a boot to a base plate of a snowboard, comprising:

a first band mounted on a first side of the base plate;

a second band mounted on a second side of the base plate opposite the first side of the base plate in a width direction;

a third band mounted on the first band at a first portion and removably attached to the second band at a second portion; and a pad fixed on the third band, the pad including a front portion connecting to a forwardmost portion of a toe end portion of the boot and a top portion connecting to an upper portion of the toe end portion of the boot, the front portion of the pad being arranged at a distance from the base plate and including a vertically extending flat surface, and the top portion including a flat surface extending at an angle from the vertically extending flat surface.

5. An apparatus for binding a boot to a base plate of a snowboard, comprising:

a fixing structure connecting a first side of the base plate to a second side of the base plate at an acute angle with respect to a toe end of the boot, the fixing structure including a belt holding a pad where a lower end of the pad holds a forwardmost portion of the toe end of the boot and a top end of the pad holds a top portion of the toe end of the boot, the pad including a convex-shaped portion connecting the upper and lower ends of the pad; and a first band removably connecting the fixing structure to the first side of the base plate.

6. The apparatus for binding a boot to a base plate of a snowboard as set forth in claim 5, the fixing structure further comprising:

a second band connecting removably to the belt, and connecting fixedly to the second side of the base plate, wherein the pad is removably connected to the first band.

7. The apparatus for binding a boot to a base plate of a snowboard as set forth in claim 5, wherein the pad has a shape matching that of the toe end portion of the boot.

8. The apparatus for binding a boot to a base plate of a snowboard as set forth in claim 5, wherein the first band is adjustable with respect to the pad.

9. The apparatus for binding a boot to a base plate of a snowboard as set forth in claim 6, wherein the pad and the belt are formed integrally.

* * * * *